US007588073B2

(12) United States Patent
Hyogo et al.

(10) Patent No.: US 7,588,073 B2
(45) Date of Patent: Sep. 15, 2009

(54) ALUMINUM ALLOY-BASED EXTRUDED MULTI-PATH FLAT TUBES FOR THE HEAT EXCHANGER AND METHOD OF MANUFACTURE THEREOF

(75) Inventors: Yasunori Hyogo, Susono (JP); Masaya Katsumata, Susono (JP); Masami Asano, Susono (JP)

(73) Assignee: Mitsubishi Aluminum Kabushiki Kaisha (JP)

( * ) Notice: Subject to any disclaimer, the term of this patent is extended or adjusted under 35 U.S.C. 154(b) by 399 days.

(21) Appl. No.: 11/418,750

(22) Filed: May 5, 2006

(65) Prior Publication Data

US 2006/0260724 A1 Nov. 23, 2006

(30) Foreign Application Priority Data

May 17, 2005 (JP) ..... 2005-144345

(51) Int. Cl.
*F28F 1/00* (2006.01)

(52) U.S. Cl. ..... 165/177; 165/180; 165/905

(58) Field of Classification Search ..... 165/177, 165/180, 905
See application file for complete search history.

(56) References Cited

U.S. PATENT DOCUMENTS 6,000,461 A 12/1999 Ross et al.

FOREIGN PATENT DOCUMENTS

| | | |
|---|---|---|
| DE | 195 15 909 A 1 | 4/1995 |
| EP | 06252203.2-2122 | 8/2006 |
| JP | 5-171328 | 7/1993 |
| JP | 10-246592 | 9/1998 |
| JP | 2005-177854 | 7/2005 |

*Primary Examiner*—Ljiljana (Lil) V Ciric
(74) *Attorney, Agent, or Firm*—Baker & Hostetler, LLP

(57) ABSTRACT

An aluminum alloy-based extruded multi-path flat tube having a multiple number of passageways extending internally through the flat tube in parallel with one another and adapted to be coupled to other such flat tubes to form a heat exchanger after performing a brazing operation with the flat tube having a surface layer extending inwardly from the external surface containing at least 5% non-recrystallized grains and having an inner layer extending from the surface area containing at least 30% recrystallized grains.

3 Claims, 6 Drawing Sheets

(a)

$$\text{Strain}(\%) = \frac{H_0 - H}{H_0} \times 100$$

(b)

$$\text{Strain}(\%) = \left(1 - \frac{T_0}{T}\right) \times 100$$

(c)

$$\text{Strain}(\%) = \left(1 - \frac{L_0}{L}\right) \times 100$$

ALUMINUM ALLOY-BASED EXTRUDED MULTI-PATH FLAT TUBES FOR THE HEAT EXCHANGER AND METHOD OF MANUFACTURE THEREOF

BACKGROUND OF THE INVENTION

1. Field of the Invention

The present invention relates to aluminum alloy-based extruded multi-path flat tubes for the heat exchanger, wherein the heat exchanger includes the flat tubes that are formed into a flat shape having multiple paths of fluid passage bores by performing the extruding operation, and may be constructed by joining those flat tubes with fins or header pipes by performing the brazing operation. The present invention also relates to a method of manufacturing such extruded multi-path flat tubes.

2. Prior Art

In general, the extruded multi-path flat tube that is used for the heat exchanger may be obtained by extruding the aluminum alloy billets and forming them into the flat shape, and the heat exchanger may be constructed by joining those flat tubes thus obtained with fins or header pipes by performing the brazing operation.

Of recent years, as demands arise for making the pipe or tube lighter or thinner or for permitting new types of coolants to be employed in the heat exchanger, a higher mechanical resistant strength is required for the extruded flat tubes that form a principal component of the heat exchanger in order to meet such demands. It may be understood, however, that the heat exchanger is constructed by joining the extruded flat tubes with other fins or header pipes by performing the brazing operation at the temperature of about 600° C. For the JIS 1XXX series alloys or Al—Mn series alloys that are used for the conventional extruded flat tubes, therefore, the mechanical resistant strength may become weakened during the brazing operation and the extruded flat tubes are actually used under the conditions in which they have the weakest mechanical resistant strength. For those recent years, therefore, studies are being made on the use of JIS 6XXX-series alloys that exhibit the comparatively good extrudability among other age-hardening alloys, in order to provide the higher mechanical resistant strength for the extruded flat tubes (see Japanese patent application now opened for the public examination under H5 (1993)-171328).

It should be noted, however, that those alloys contain Mg that may reduce the extrudability as compared with the other conventional alloys. It is thus practically impossible or difficult to extrude them into the flat tubes as required. Furthermore, Mg may react with Nocolok flux that is generally used for the brazing operation, which may reduce the brazability remarkably.

SUMMARY OF THE INVENTION

The present invention is made by considering the situations described above under the "BACKGROUND". An object of the present invention is therefore to provide aluminum alloy-based extruded multi-path flat tubes for the heat exchanger that can retain the high proof strength as desired without the risk of reducing the extrudability or brazability during the respective operations. Another object of the present invention is to provide a method of manufacturing such aluminum alloy-based extruded multi-path flat tubes of the heat exchanger.

In order to solve the problems described above, a first aspect of the present invention is to provide the aluminum alloy-based extruded multi-path flat tubes for the heat exchanger in which the tubes include a surface layer extending inwardly from the external surface of each flat tube containing equal to 5% or more than 5% of non-recrystallized grains as expressed in terms of the area ratio and an inner layer extending inwardly from said surface layer containing recrystallized grains, even after the tubes have been brazed.

A second aspect of the present invention is to provide the aluminum alloy-based extruded multi-path flat tubes for the heat exchanger according to the first aspect of the present invention, wherein the area of the extruded multi-path flat tube having the thickness that is ½ of the thickness (the middle point located between the surface and inner bore surface) contains 30% to 100% of recrystallized grains as expressed in terms of the area ratio.

Specifically, the aluminum alloy-based extruded multi-path flat tube according to each of the aspects of the present invention contains the non-recrystallized grains after it has been brazed. Thus, it can provide the high proof strength, and shows the excellent pressure-resistant strength. The extruded flat tubes that are used in the heat exchanger are usually multi-path tubes having many bores through which the fluid such as the coolant can flow. The pressure-resistance test that has occurred for those multi-path tubes shows that the inner partition walls will initially be broken and destructed. For the extruded flat pipes according to the present invention, the enhanced pressure-resistant strength can be obtained because the proof strength can be increased as described above.

Generally, the part of the extruded flat tube containing the non-recrystallized grains might be affected by the filler erosion that may occur during the brazing operation, and the thickness of that part may be reduced by the filler erosion. This may decrease the mechanical resistant strength. In contrast, for the extruded flat tubes according to the present invention, the filler erosion that might occur during the brazing process can be prevented since the tube contains the recrystallized grains. Particularly, as the filler erosion can be prevented by the recrystallized grains contained in the inner layer of the flat tube, there is no risk that the brazing operation will fail on the inner layer of the tube. In accordance with the first aspect of the present invention, it is specified that the non-recrystallized grains contained in the inner layer of the flat tube should desirably have the ratio of equal to 5% or more than 5% as expressed in terms of the area ratio. As the non-recrystallized grains are increased, the proof strength will be increased accordingly. It is desirable, therefore, that the ratio of the non-recrystallized grains should be equal to 50% or more than 50%. It should be noted, however, that as the ratio of the non-recrystallized grains is increased, the ratio of the recrystallized grains will necessarily be decreased accordingly. This may have the influence of spoiling the anti-filler erosion during the brazing process. The preferred ratio of the non-recrystallized grains should be equal to 95% or less than 95%, and the more preferred ratio should be equal to 90% or less than 90%. Preferably, the surface layer should have the thickness of 5 μm to 150 μm when it is measured from the surface.

Furthermore, the recrystallized grains that reside on the inner layer side inside the surface layer can prevent the filler erosion from occurring during the brazing process. The presence of the recrystallized grains inside the surface layer can be determined by the ratio of the recrystallized grains (area ratio) in the middle area that is ½ thick (the middle point located between the surface and inner bore surface) and may be located as part of the inner layer. The middle point is usually located 100 μm to 250 μm deep. If a certain ratio of the recrystallized grains as specified below is located in this depth, the recrystallized grains can also be distributed in the layer nearer to the surface layer. Thus, the filler erosion can be prevented. Specifically, if the ratio of the recrystallized grains located in the middle point is less than 30%, the filler erosion cannot be prevented. This means that the preferred ratio of the recrystallized grains should be equal to 30% or more than 30%. The more preferred ratio should be equal to 40% or more than 40% in order to ensure that the filler erosion will be prevented.

The non-recrystallized grains which have subgrain boundaries contained in the flat tube after it is brazed should desirably have the average grain size of between 0.1 μm and 20 μm as described above. The reason is that if the average grain size is less than 0.1 μm, it may increase the filler erosion remarkably, while if it is more than 20 μm, the sufficient proof strength cannot be obtained.

Similarly, the recrystallized grains should desirably have the average grain size of equal to 50 μm or more than 50 μm as described above. If it is less than 50 μm, the filler erosion cannot be prevented adequately. The reason is that the recrystallized grains should be rather rough since the filler erosion begins with the crystallized grain boundaries.

In accordance with the present invention, the non-recrystallized grains may be defined as "the crystallized grains both having each crystal orientation difference being equal to 20 degrees or less than 20 degrees and having each average grain size of equal to 20 μm or less than 20 μm for each adjacent grains". Similarly, the recrystallized grains may be defined as "the crystallized grains both having each crystal orientation difference being than 20 degrees and having each average grain size of more than 20 μm for each adjacent grains". It is specified that the recrystallized grains may have the average grain diameter of equal to 50 μm or more than 50 μm while the non-recrystallized grains may have the average grain diameter of 0.1 μm to 20 μm.

The method of manufacturing the aluminum alloy-based extruded multi-path flat tubes for the heat exchanger in accordance with the present invention includes the steps of performing the extrusion operation to obtain an aluminum alloy-based flat tube and performing the low strain working on the thus extruded aluminum alloy-based flat tube at the low strain of 2% to 15% prior to performing the brazing operation.

In accordance of the manufacturing method of the present invention, the low strain working may be operated on the extruded flat tube so that some non-recrystallized grains can still remain in the tube after the brazing operation is performed. By so doing, the proof strength can be improved. Specifically, in order that the non-recrystallized grains can still remain after the brazing operation is completed, an adequately low strain (strain of 2% to 15%) may be applied to the tube after it is extruded, and then the tube may have the brazing process. In order that the non-recrystallized grains can still remain in the tube during the low strain working process even until the brazing process is completed, an adequate strain may be applied. As the tube also contains an adequate amount of recrystallized grains, the anti-filler erosion can be increased during the brazing operation. Preferably, the strain should have the lower limit of 4% or the upper limit of 10%. The reason is that if the strain is less than the lower limit or more than the upper limit, the sufficient amount of non-crystallized grains cannot remain after the brazing operation is completed, which may reduce the proof strength of the tube.

The low strain working may occur in several methods, such as the roller's rolling or tension working, bending working, press compression working and the like. It should be noted that the present invention is not limited to the methods mentioned above.

For the working case where the height of the flat tube is to be decreased, the strain described above may be expressed as (1−H/HO) * 100%, in which $H_o$ refers to the height of the flat tube prior to the low strain working process, and H refers to the height of the flat tube after the low strain working process is completed (see FIG. 2 (*a*)).

When the strain is measured by observing the section across the tube, it may be expressed as $(1-T_o/T) * 100\%$, in which $T_o$ refers to the thickness of the inner partition walls of the flat tube prior to the low strain working process, and T refers to the thickness of the same after the low strain working process is completed (see FIG. 2 (*b*)).

For the working case where the strain is applied by the tension, the strain may be expressed as $(1-L_o/L) * 100\%$, in which $L_o$ refers to the length of the flat tube prior to the low strain working process, and L refers to the length of the same after the low strain working process is completed (see FIG. 2 (*c*)). In this case, the strain may also be expressed as $(1-W_o/W) * 100\%$, in which $W_o$ refers to the width of the flat tube prior to the low strain working process, and W refers to the width of the same after the low strain working process is completed.

It may be appreciated from the foregoing description that the aluminum alloy-based extruded multi-path flat tube for the heat exchanger according to the present invention has the advantage in that it contains equal to 5% or more than 5% of non-recrystallized grains in the surface layer prior to the brazing operation that enables the tube to provide the enhanced pressure resistant capability against the high pressures of the coolant that passes through the fluid passage bores.

It may also be appreciated from the foregoing description that the method of manufacturing the aluminum alloy-based extruded multi-path flat tubes for the heat exchanger in accordance with the present invention has the advantage in that it enables the low strain working process to be performed at the strain of 2% to 15% to the aluminum alloy-based multi-path flat tube obtained during the preceding extruding process and prior to the following brazing process, thereby ensuring that the tube can have the organization that contains the non-recrystallized grains after the tube has been processed during the brazing operation.

BEST MODES OF EMBODYING THE INVENTION

One preferred embodiment of the present invention is now described below by referring to the accompanying drawings.

The aluminum alloy billets having the specific composition may be dissolved by using any usual method. It may be appreciated that the present invention is not restricted to the particular aluminum alloy having the particular composition that will be presented below. Any of the compositions, such as JIS A3003, 1050, 1100 alloys and the like, may be chosen as appropriate.

The aluminum alloy billet may be hot-extruded into the extruded flat pipe having the desired shape by using any of the usual methods. The hot-extruding operation may preferably occur at the billet temperatures of between 400° C. and 550° C. and at the extruding speed of 10 m/min to 150 m/min.

Figure 1:
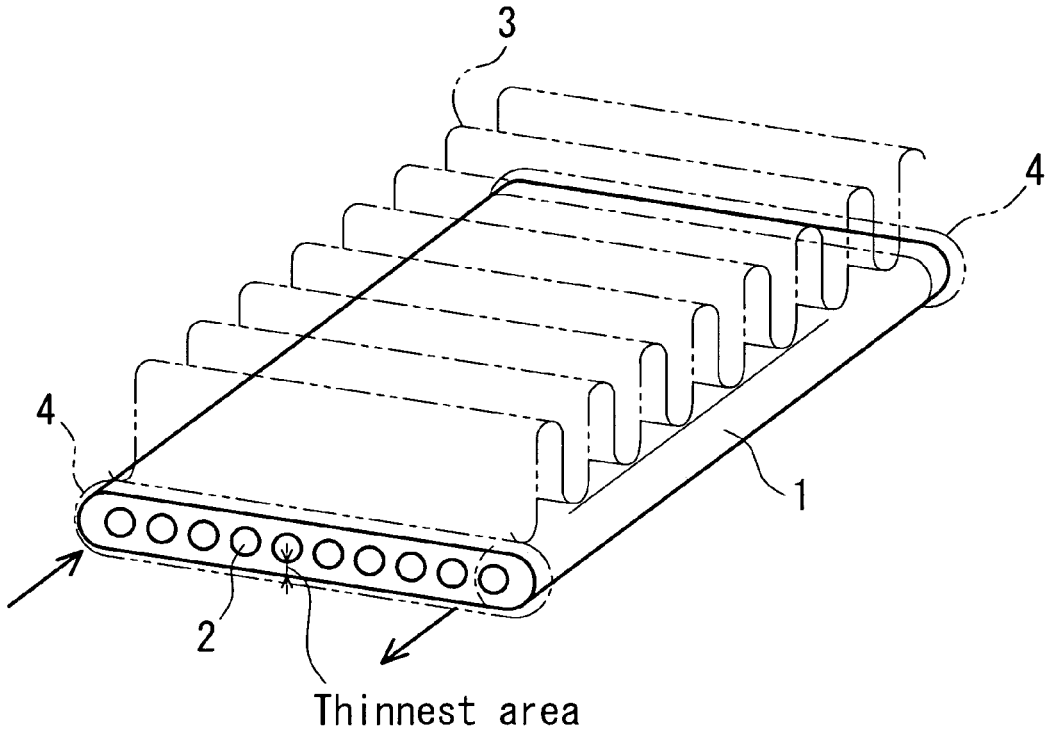
FIG. 1 is a perspective view illustrating the extruded flat tube in accordance with one embodiment of the present invention.

As shown in FIG. 1, the extruded flat tube 1 thus obtained has a path of fluid passage 2 arranged in parallel rows, and has the generally flat shape. It should be noted that those multi paths of fluid passage 2 may have the round or square shape, but the round shape is preferred because it makes it easier to control the organization in the inner surface layer.

Figure 2:
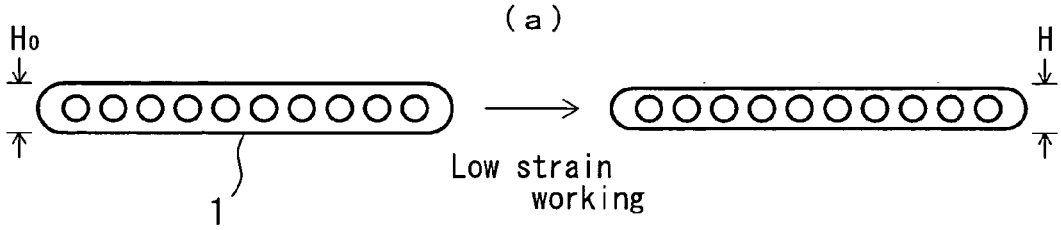
FIG. 2 explains how the strain factor or rate can be determined for the extruded flat tube in accordance with the embodiment of FIG. 1.
Figure 2:
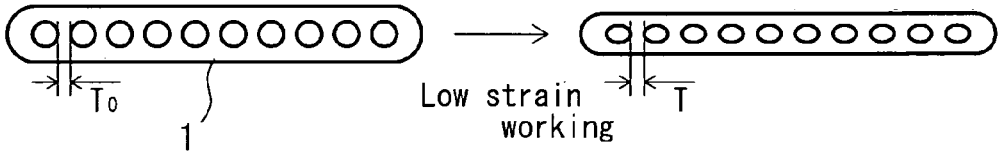
Figure 2:
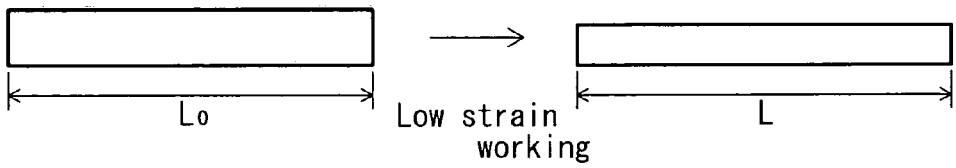

Then, the low strain working operation may occur at the strain of 2% to 15% to the extruded flat pipe. The low strain working operation may be performed by the roller rolling method, for example. As shown in FIG. 2 (*a*), for example, the strain at which the low strain working operation occurs may be expressed as below:

$$\text{Strain rate } (\%)=(1-H/H_o) * 100$$

in which $H_o$ refers to the height of the tube prior to the brazing operation, and H refers to the height of the tube after the brazing operation is completed.

Figure 3:
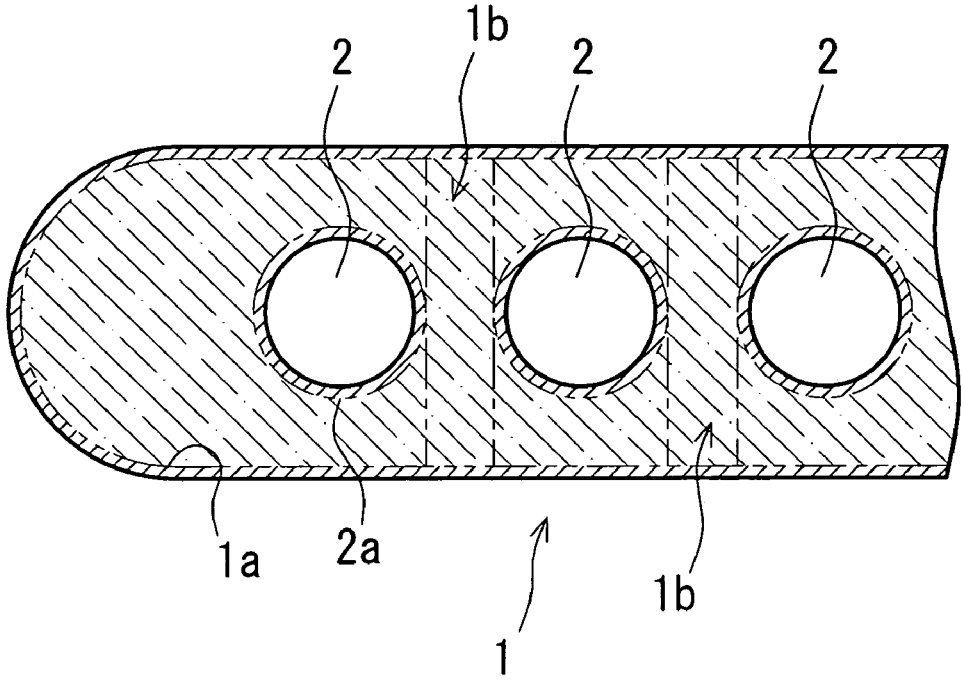
FIG. 3 is a schematic diagram illustrating the internal organization for the extruded flat tube in accordance with the embodiment of FIG. 1.

Several extruded flat tubes 1 may be arranged in parallel, and may be joined with fins 3, header pipes 4 and others. Then, the brazing operation may occur during which the assembly thus obtained is heated. The conditions under which the brazing operation should occur are arbitrary. For example, the brazing operation may occur at the temperatures of between 590° C. and 610° C., and may usually hold for 1 to 10 minute. When the end of the extruded flat tubes 1 is joined with the corresponding header pipe 4 during the brazing operation as shown in FIG. 3, the extruded flat tube 1 may include the surface layer 1*a* and the inner fluid passage bore surface layer 2*a*, each containing mainly the non-recrystallized grains, and may also include the inner layer as well as the inner partition area 1*b* located between the adjacent inner fluid passage bore surface layers 2*a*, 2*a* that contain mainly the recrystallized grains.

Figure 4:
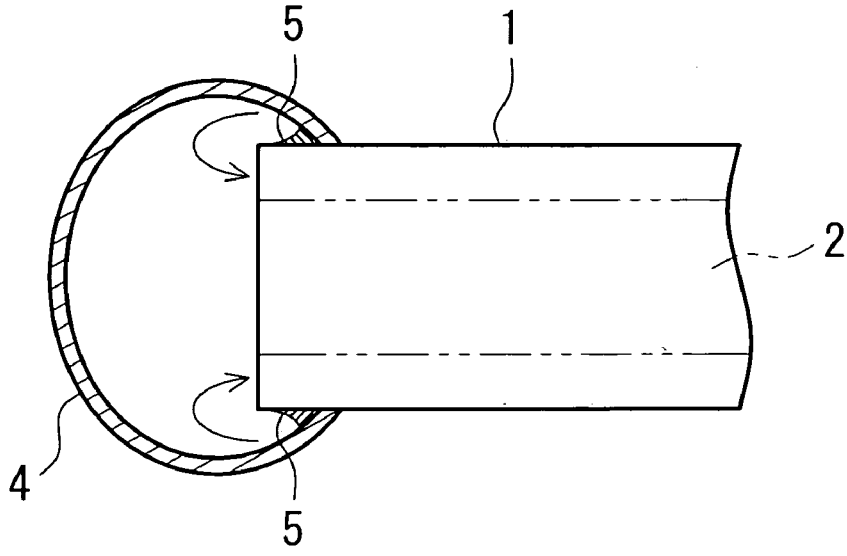
FIG. 4 illustrates how the extruded flat tubes are joined with the header tubes in accordance with the embodiment of FIG. 1.

While the brazing operation proceeds, as shown in FIG. 4, there are cases where the dissolved filler 5 may make contact with the surface of the extruded flat tube 1 or may flow around the path of fluid passage 2, but this filler erosion can be avoided by the recrystallized grains that are contained in the inner side of the tube.

After the heat of the brazing operation is completed, the surface layer 1 and inner fluid passage bore surface layer 2*a* contain mainly the non-recrystallized grains while at the same time the inner layer, particularly the inner partition area 1*b* contain mainly the recrystallized grains. For the final extruded flat tube thus obtained, the high proof strength can be provided by the non-recrystallized grains as described above, and the excellent pressure resistant strength can be obtained accordingly.

The particular embodiment of the present invention has been described so far, but it should be understood that the present invention is not restricted to the embodiment, which may be modified in numerous manners without departing from the spirit and scope of the invention.

The present disclosure relates to subject matter contained in priority Japanese Patent Application No. 2005-144345, filed on May 17, 2005, the content of which in herein expressly incorporated by reference in its entirely.

EXAMPLES

One typical examples of the embodiment of the present invention is now described. In this example, several inventive samples are presented in order to compare with other non-inventive samples.

JIS A3003 alloy is dissolved and cast into a billet having the diameter of 20 cm. Then, this billet is homogenized under the normal conditions, and is then extruded. The result is an extruded flat tube having the width of 20 mm, the height of 2 mm and the thinnest part of 0.3 mm and having ten round paths of for fluid passage such as coolant to pass therethrough.

Then, the extruded flat tube is rolled through the upper and lower rollers, in which it is subjected to the low strain working. This is followed by the brazing operation during which the tube is heated at 600° C. for three minutes, for which the tensile testing is carried out at the room temperature. For example, an inventive sample No. 8 is obtained by applying the low strain tension to the tube. Table 1 shows the applied strain and mechanical property for each of the inventive and non-inventive samples.

The organization for the surface layer and middle point located between the surface and bores of the extruded flat tube is observed by using EBSP (Electron Back-Scatter diffraction Pattern) apparatus. This organization observation occurs in order to determine the crystallized grain orientation, crystallized grain diameter, and occupation ratio (area ratio). The surface layer is observed for the flat plane surface, and the middle point between the surface and bore is observed after the area from the surface down to the middle point is polished. The middle point corresponds to the middle point of the thinnest area (FIG. 1).

1. Determining the Crystallized Grain Orientation
   <Measuring Apparatus> EBSP
   <Measuring Range> one field view of 400 μm×400 μm
   <Orientation Boundary> 20 degrees (relative to the extruding direction)
2. Determining the Crystallized Grain Diameter
   <Measuring Apparatus> EBSP
   <Measuring Range> one field view of 400 μm×400 μm
   <Measuring Method> for each of the crystallized grains being observed, the greatest crystallized grain diameter is determined by the line segment parallel with the extruding direction.
3. Determining the Occupation Rate
   <Measuring Apparatus> EBSP
   <Measuring Range> one field view of 400 μm×400 μm
   <Measuring Method> for all of the non-recrystallized grains (or recrystallized grains) being observed, the occupation ratio (%) within the above measuring range is determined.

Figure 5:
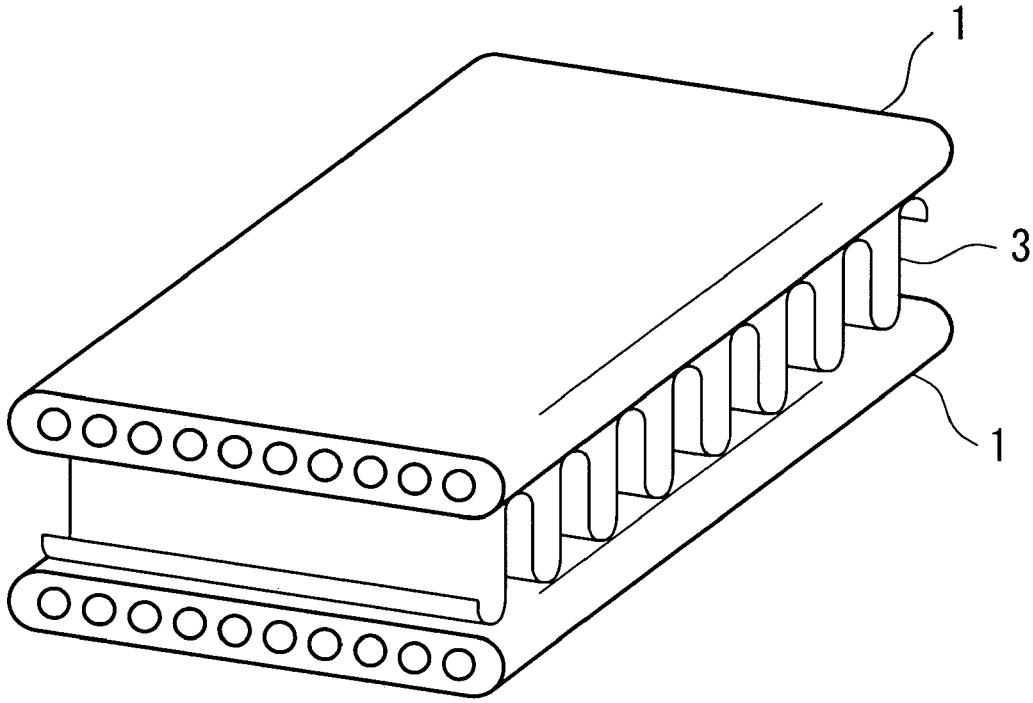
FIG. 5 is a perspective view illustrating the assembly that may be used to estimate the filler erosion in accordance with the embodiment of FIG. 1.
Figure 6:
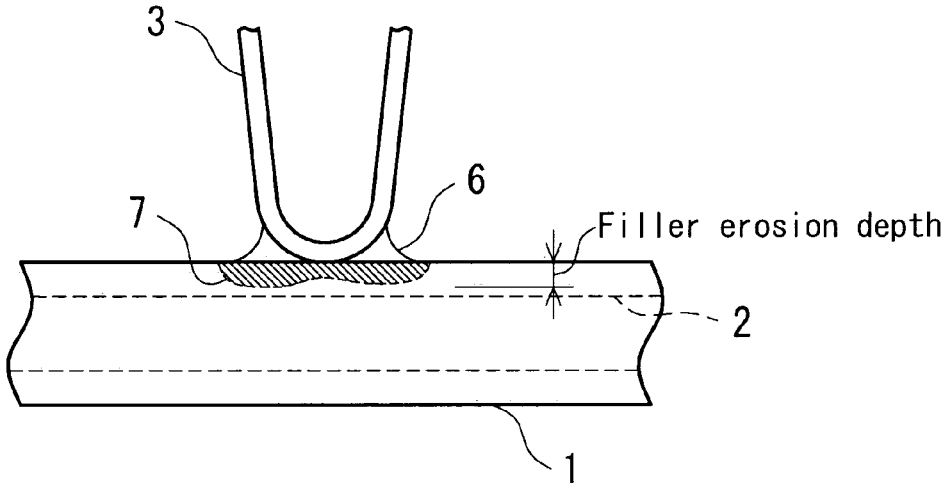
FIG. 6 illustrates how the filler erosion can be estimated in accordance with the embodiment of FIG. 1.

For each of the samples being tested, the filler erosion is checked. For this purpose, a clad fin material 3 of 0.1-mm thickness that includes a core material (JIS A3003) on both sides of which a brazing material (JIS A4045) is applied at the clad ratio of 10% is assembled with the extruded flat tubes 1, 1 as shown in FIG. 5. Then, the assembly is brazed at 600° C. for three minutes. After the brazing operation, the section across the joints between the fin 3 and extruded flat tubes 1, 1 is observed to determine the depth of the filler erosion that affects the extruded flat tubes 1, 1 (FIG. 6). In FIG. 6, reference numeral 6 refers to the fillet, and reference numeral 7 refers to the area affected by the filler erosion. The rating for the filler erosion that occurs over the depth of equal to ⅓ or less than ⅓ of the thinnest area beginning with the tube surface is indicated by ○, and the rating for the filler erosion that occurs over the depth of more than ⅓ of the thinnest area beginning with the tube surface is indicated by Δ.

As a result of the above observation, the crystallized grains both having the difference in each adjacent crystallized grain orientation being equal to 20% or less than 20 degrees and having each crystallized grain diameter being equal to 20 μm or less than 20 μm may be defined as non-recrystallized grains, while the crystallized grains both having the difference in each adjacent crystallized grain orientation being more than 20 degrees and having each crystallized grain diameter being equal to 20 μm or more than 20 μm may be defined as recrystallized grains. The results of the observation are shown in Table 1.

As shown in Table 1, the surface of each of the inventive samples No. 1 to 8 contains equal to 5% or more than 5% of non-recrystallized grains, which clearly means that it has the high proof strength. Each of the inventive samples Nos. 1 to 7 contains more than 30% of recrystallized grains internally, which means that it has the good filler erosion resistance as compared with the inventive sample No. 8 that contains less than 30% of recrystallized grains internally.

TABLE 1

| Sample No. | | Strain (%) | Surface layer Crystallized Grains (%) Non | Middle point Crystallized Grains (%) Re | Tensile Strength (MPa) | Proof Strength (MPa) | Brazing filler erosion |
|---|---|---|---|---|---|---|---|
| Inventive samples | 1 | 2 | 21 | 92 | 115 | 45 | ○ |
| | 2 | 4 | 51 | 84 | 115 | 48 | ○ |
| | 3 | 5 | 72 | 77 | 116 | 51 | ○ |
| | 4 | 6 | 92 | 50 | 117 | 55 | ○ |
| | 5 | 8 | 65 | 45 | 117 | 53 | ○ |
| | 6 | 10 | 48 | 87 | 115 | 51 | ○ |
| | 7 | 15 | 15 | 95 | 114 | 49 | ○ |
| | 8 | 13 | 73 | 29 | 117 | 52 | Δ |
| Non-inventive samples | 1 | 1 | 4 | 97 | 109 | 40 | ○ |
| | 2 | 18 | 2 | 97 | 110 | 41 | ○ |

Crystallized grains (org) (%) = area ratio
Non: non-recrystallized grains
Re: recrystallized grains

What is claimed is:

1. An aluminum alloy-based extruded multi-path flat tube having a substantially flat shape and a multiple number of passageways extending internally through the flat tube in parallel with one another permitting the passage of cooling fluid there through wherein said flat tube is adapted to be coupled to other such flat tubes to form a heat exchanger after performing a brazing operation wherein said flat tube comprises:

a surface layer extending inwardly from the external surface of the flat tube containing at least 5% or more of non-recrystallized grains relative to crystallized grains as expressed in terms of the area ratio; and an inner layer extending from said surface layer containing recrystallized grains.

2. An aluminum alloy-based extruded multi-path flat tube for a heat exchanger as defined in claim 1, wherein said inner layer forms a middle area within said tube extending to one half of the tube thickness (½) with a middle point located between the surface layer and the surface of an inner bore of said tube and contains 30% to 100% of recrystallized grains as expressed in terms of the area ratio.

3. An aluminum alloy-based extruded multi-path flat tube for a heat exchanger as defined in claim 1 further comprising a partition area extending laterally between each of the multiple passageways containing recrystallized grains.

* * * * *